US007131387B1

(12) United States Patent
Czipri

(10) Patent No.: US 7,131,387 B1
(45) Date of Patent: Nov. 7, 2006

(54) FOLDING CLEAT WITH SPRING ACTUATION

(76) Inventor: John Czipri, 344 E. Lake Rd., Palm Harbor, FL (US) 34685

( * ) Notice: Subject to any disclaimer, the term of this patent is extended or adjusted under 35 U.S.C. 154(b) by 359 days.

(21) Appl. No.: 10/880,129

(22) Filed: Jun. 29, 2004

(51) Int. Cl.
*B63B 21/04* (2006.01)

(52) U.S. Cl. ..... 114/218

(58) Field of Classification Search ..... 114/218; 410/107, 111; D12/317
See application file for complete search history.

(56) References Cited

U.S. PATENT DOCUMENTS

| | | | | |
|---|---|---|---|---|
| 2,339,034 | A | 1/1944 | Siska | |
| 4,270,478 | A | 6/1981 | Kafka et al. | |
| 4,354,445 | A | 10/1982 | Kafka et al. | |
| 4,964,355 | A * | 10/1990 | Milewski | 114/218 |
| 5,301,627 | A | 4/1994 | Czipri | |
| 5,438,944 | A * | 8/1995 | Burke | 114/218 |
| 5,535,694 | A | 7/1996 | Czipri | |
| 5,983,820 | A | 11/1999 | Whitley | |
| D430,099 | S | 8/2000 | Sobey | |
| 6,125,779 | A | 10/2000 | Czipri | |
| 6,234,101 | B1 | 5/2001 | Czipri | |
| D458,891 | S | 6/2002 | Whitley | |
| 6,533,512 | B1 * | 3/2003 | Lin | 410/102 |
| 6,588,355 | B1 | 7/2003 | Whitley, II et al. | |

* cited by examiner

*Primary Examiner*—Sherman Basinger
(74) *Attorney, Agent, or Firm*—McKee, Voorhees & Sease, P.L.C.

(57) ABSTRACT

A folding boat cleat which is secured to a boat hull includes a base secured to the boat hull, the base including a gap and a cleat head rotatably secured at one end to the base. A spring is secured between the cleat head and the base and operates to bias the cleat head toward an upward or operative position. A slider is secured within the base and includes a latch portion which engages the cleat head when the cleat head is in a folded position within the gap and a thumb portion which allows a user to retract the latch portion and release the cleat head to rotate approximately 90° into an upward or operative position. Preferably, the slider is spring loaded. A torsion coil spring is also preferably used to bias the cleat head towards an upward or operative position. The cleat head preferably includes a plurality of legs.

6 Claims, 2 Drawing Sheets

FOLDING CLEAT WITH SPRING ACTUATION

BACKGROUND OF THE INVENTION

The present invention relates generally to cleats having a retracted, folded or depressed inoperative position and which are capable of being raised to an upright operative position. More particularly, the present invention relates to a cleat that is easily folded to be flush with the surface of its base in the inoperative position and easily raised and secured to the operative position.

Cleats having a depressed inoperative position which can be moved to an operative position are well known in the art. Such cleats are generally shown in U.S. Pat. Nos. 6,125,779, 5,535,694, and 5,301,627, all to Czipri. Folding cleats have been particularly described in and shown in U.S. Pat. No. 4,270,478 to Kafka et al. and U.S. Pat. No. 5,438,944 to Burke.

Various such prior art devices initially appear to be flush with the outer surface of a boat on which they are mounted. However, the majority of the device is actually concealed underneath the device surface. Such devices, as shown in U.S. Pat. No. 4,270,478 to Kafka require extensive holes are cut in the sides of boats on which they are installed. Moreover, the amount of subsurface room that such devices occupy may typically be put to better use. It is therefore desirable to have a folding boat cleat that occupies a minimum amount of interior or subsurface space.

Other folding cleats, such as those shown in U.S. Pat. No. 5,438,944 to Burke require a user to manually lift the boat cleat from its space and maintain it in an upright or operative position during use. However, securing a boat typically requires two hands and therefore it is desirable to have a cleat which may be maintained in the operative position without any assistance from the user.

It is therefore a primary feature of the present invention to overcome the problems in the prior art.

It is a further feature of the present invention to provide a foldable boat cleat that takes up a minimum of interior space.

Another feature of the present invention is to provide a foldable boat cleat that is easily operated and secured by a user.

A still further feature of the present invention is the provision of a foldable boat cleat that may be secured in the operative position without any additional effort from the user.

These, as well as other features, objects, and advantages of the present invention will become apparent from the following specification and claims.

SUMMARY OF THE INVENTION

The present invention generally comprises a folding boat cleat including a base which is secured to a boat, the base including a gap to accommodate a cleat head which is rotatably secured at one end to the base, a spring which biases the cleat head in an upward or operative position, and a slider which is secured to the base wherein the slider includes a latch portion that engages the cleat head wherein the cleat head is in a folded position. The slider is preferably spring loaded with a torsion coil spring and includes a thumb portion. The cleat head preferably includes a plurality of legs. To activate the cleat, the user simply pulls back on the slider thus releasing the cleat head which is subsequently biased to the operative position by the torsion coil spring. Preferably, the torsion coil spring is secured to the cleat head on one or more of the legs.

DETAILED DESCRIPTION OF THE PREFERRED EMBODIMENT

Figure 1:
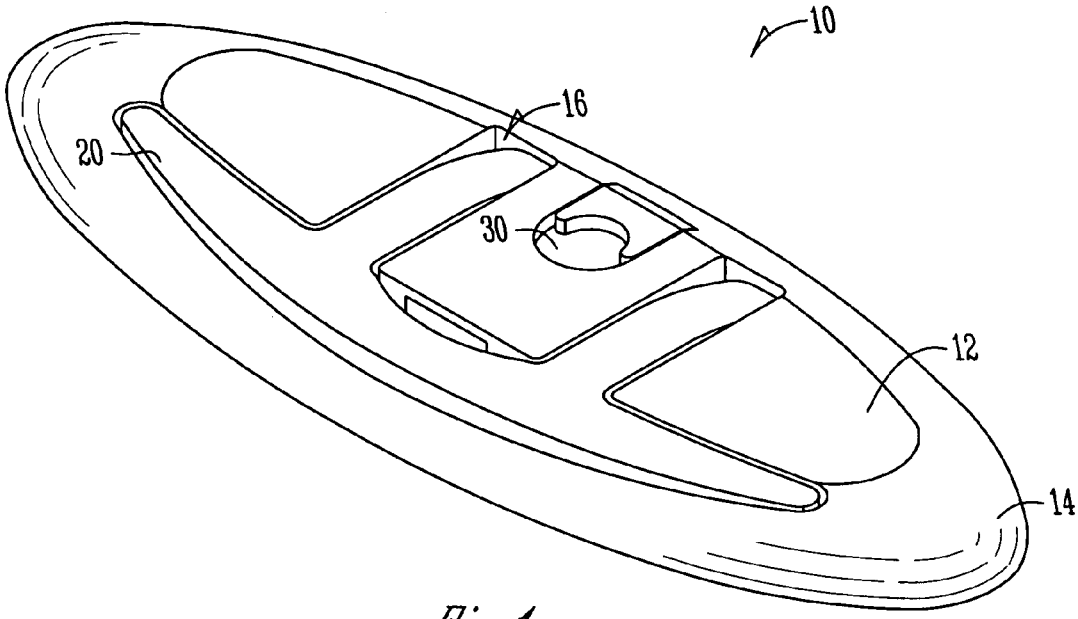
FIG. 1 is a perspective view of one embodiment of the foldable boat cleat in the folded position.
Figure 2:
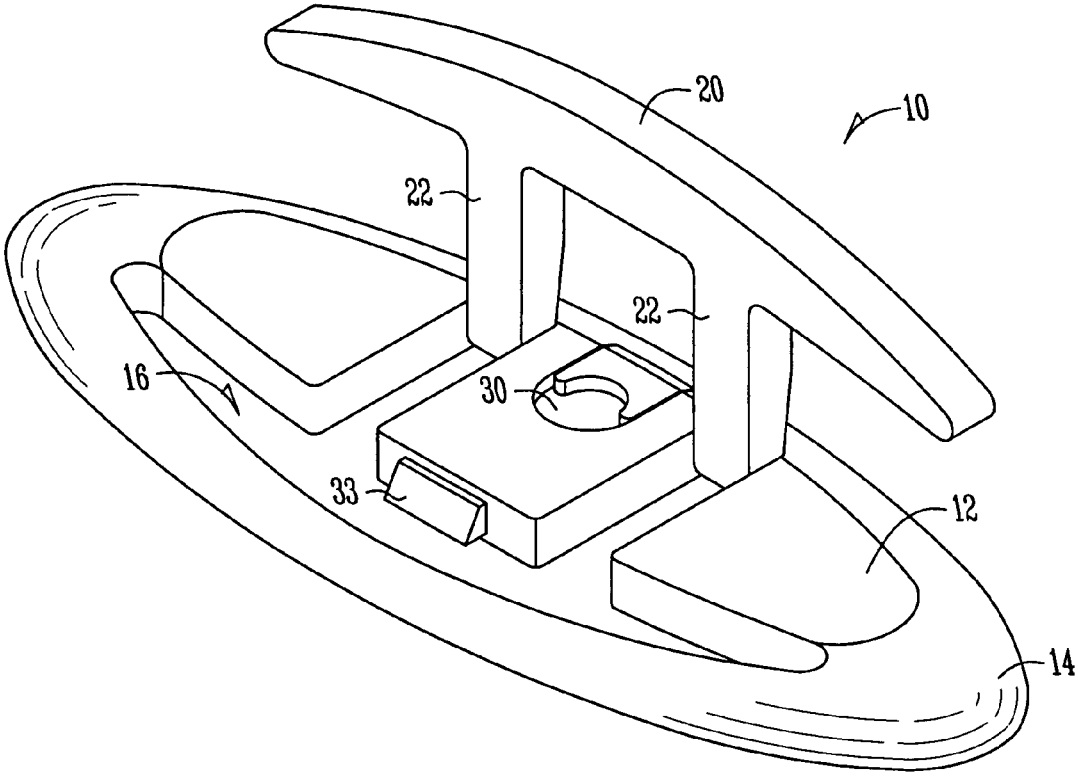
FIG. 2 is a perspective view of one embodiment of the foldable boat cleat shown in the operative or unfolded position.

The present invention will be described as it applies to its preferred embodiment. It is not intended that the present invention be limited to the described embodiment. It is intended that the invention cover all modifications and alternatives which may be included within the spirit and scope of the invention. Now, referring to the drawings, FIG. 1 illustrates the cleat 10 having a base 12 including smooth sides 14 and a gap 16 for the cleat head 20 and cleat legs 22. FIG. 1 illustrates the cleat head 20 in a retracted or folded position. As is shown in FIG. 2, when the user releases the cleat head 20, the cleat head 20 automatically moves into the unfolded or operative position to expose a plurality of flanges 28. Within the base 12, a spring loaded slide 30 includes a thumb portion 32 and a latch portion 33. To move the cleat head 20 into the unfolded or usable position, the user simply pulls back on the thumb portion 32 which also pulls back on the latch portion 33 to release the cleat head 20 into the operative position.

Figure 3:
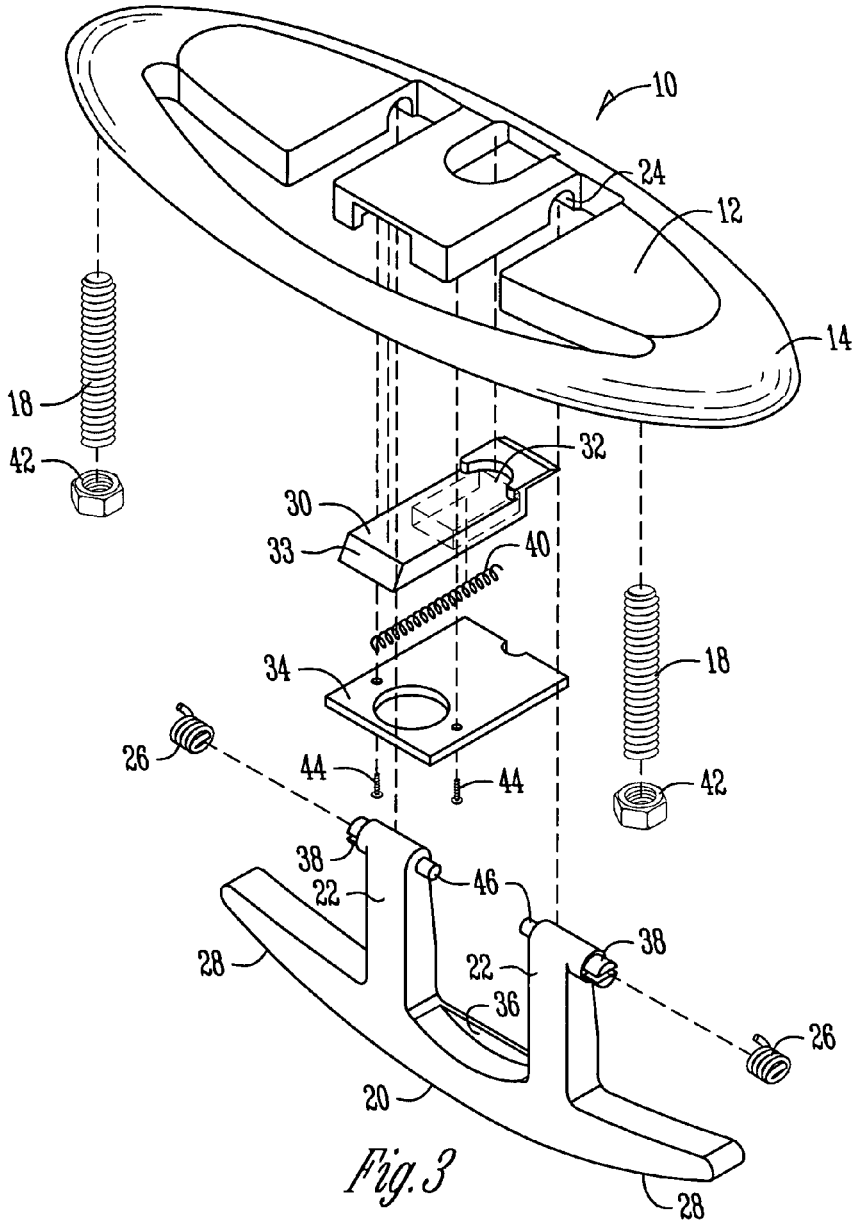
FIG. 3 is an exploded view showing the preferred components of one embodiment of the foldable boat cleat of the present invention.
Figure 4:
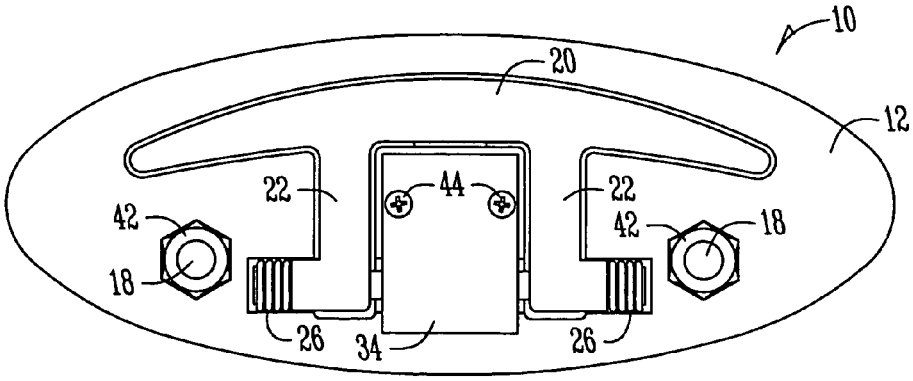
FIG. 4 is a bottom view of the foldable boat cleat of the present invention.

As is shown in FIG. 3, the cleat 10 of the present invention includes the base 12 to which a number of parts are secured. These parts preferably are made of stainless steel and include a pair of screws 18 or other type of fasteners which allow the cleat 10 to be secured in a proper position to a boat hull with a plurality of nuts 42. A slide 30 is inserted underneath the base 12 such that the thumb portion 32 of the slide 30 is accessible by user. The slide 30 also includes a latch portion 33. A coil compression spring 40 is inserted between the slide the 30 and the side of the base 12 such that the spring is compressed in a generally horizontal direction when the user pulls back on the thumb portion 32 of the slide 30. To maintain the slide 30 and the spring 40 in a properly secured position under the base 12, a base plate 34 is secured to the bottom of the base 12 underneath the slide 30 by a plurality of screws 44 or other fasteners.

However, before the base plate 34 is secured, the cleat head 20 and legs 22, which includes a plurality of cylindrical tabs 46 defining a rotational axis, are rotatably positioned within the base 12 by inserting the tabs 46 into the slots 24 of the base 12. Preferably, the slots 24 allow the cleat head 20 to rotate about the axis of the tabs 46.

Opposite the tabs 46 are spring slotted cylindrical ends 38. A plurality of end springs 26 include a cross piece that fits within the slot of the ends 38 and an opposite end piece with abuts against the edge of slot 24 in base 12. The spring 26 is positioned on the cylindrical end 38 such that the spring forces act to raise cleat head 20 into an upright or operable position as is shown in FIG. 2. Moreover, cylindrical ends 38 are tapered or otherwise diminished in their diameter to ensure that spring 26 fits within slot 24 of the base 12. Once the springs 26 have been fitted on the ends 38, the entire cleat head 20 is placed into the gap 16 from the underside of base 12. Then, the cleat head 20 and the slide 30 are secured in place with screws 44 that tighten the base plate 34 to the bottom of the base 12. In this position, the latch portion 33 of the slide 30 contacts the lip 36 of the cleat head 20. When retracted, the latch portion 33 of the slide 30 is removed from engagement with the lip 36 of the cleat head 20, thus allowing the spring forces of the spring 26 to move the cleat head 20 into its upright and operative position as shown in FIG. 2.

A general description of the present invention as well as a preferred embodiment to the present invention has been set forth above. Those skilled in the art to which the present invention pertains will recognize and e able to practice additional variations in the methods and systems described which fall within the teachings of this invention. Accordingly, all such modifications and additions are deemed to be within the scope of the invention which is to be limited only by the claims appended hereto.

What is claimed is:

1. A folding boat cleat, the cleat comprising:

a base secured to a boat, the base including a gap;

a cleat having a head and a pair of legs rotatably secured at one end to the base;

a spring that operates to bias the cleat head towards an upward position;

a slider secured to the base at a location between the legs of the cleat, the slider including a latch portion which engages the cleat head when the cleat head is in a folded position within the gap.

2. The folding boat cleat of claim 1 wherein the slider is spring loaded.

3. The folding boat cleat of claim 1 wherein the slider includes a thumb portion.

4. The folding boat cleat of claim 1 wherein the spring is a torsion coil spring.

5. A boat including a folding boat cleat, the boat comprising:

a hull;

a folding boat cleat secured to the hull, the folding boat cleat including a base, a cleat head and a pair of legs, the cleat head and legs being rotatably secured to the base, and the cleat head having a non-operative position where the cleat head is substantially contained within the base and an operative position where the cleat head rotates approximately 90° to expose a plurality of flanges;

a spring to bias the cleat to the operative position; and a latch between the cleat legs to releasably secure the cleat head in the non-operative position.

6. The boat including a folding boat cleat of claim 5 wherein the base includes a gap sized to accommodate the cleat head.

* * * * *